United States Patent [19]

Graham, Sr.

[11] Patent Number: 4,647,969

[45] Date of Patent: Mar. 3, 1987

[54] INSTANT T.V. PENALTY FLAG ALERT SYSTEM

[76] Inventor: Richard P. Graham, Sr., 202 Brompton Rd., Garden City, N.Y. 11530

[21] Appl. No.: 677,061

[22] Filed: Nov. 30, 1984

[51] Int. Cl.[4] ..... H04N 5/222; H04N 7/08

[52] U.S. Cl. ..... 358/142; 358/183; 358/185; 273/55 R; 340/323 R

[58] Field of Search ..... 358/142, 141, 183, 185, 358/22, 94; 340/323 R, 306; 455/70, 100, 103, 54; 272/3; 273/55 R, 55 A, 55 C

[56] References Cited

U.S. PATENT DOCUMENTS

| | | | |
|---|---|---|---|
| 3,183,443 | 5/1965 | Lefevre | 455/100 |
| 4,254,404 | 3/1981 | White | 455/53 |
| 4,541,013 | 9/1985 | Alpert | 358/142 |

*Primary Examiner*—Tommy P. Chin
*Attorney, Agent, or Firm*—Richard L. Miller

[57] ABSTRACT

An instant television penalty flag alert system is provided which superimposes a video flag upon video images of sports events in progress, such as football or hockey. A plurality of spotters are equipped with transmitter which are activated whenever a predetermined event, such as a penalty call, is observed. A receiver detects the transmitted signal and superimposes the video flag which alerts the viewer that a penalty has been called. Transmitters may be frequency coded to identify the spotter to a control operator, and/or announcer, and/or the viewing audience. Alternatively, various modulation schemes, such as amplitude modulation, frequency modulation or pulse width modulation may be used. The actual position of the play may be transmitted using a transmitter with alpha-numeric input.

8 Claims, 3 Drawing Figures

INSTANT T.V. PENALTY FLAG ALERT SYSTEM

BACKGROUND OF THE INVENTION

The present invention relates generally to the field of signalling devices, and, more specifically, to systems for transmitting the occurrence of an event upon a playing field, such as football, to a television viewing audience.

At the present state of the art, a sports announcer is not immediately aware of penalties called upon the playing field. This is due, in large measure, to the practice of the announcer observing the same video display that a viewer sees. As a result, the announcer and the viewers often observe a playing sequence long after a penalty has been called and the outcome of the play has been moot. This causes the viewer to become irate and causes the announcer to appear ill-informed.

SUMMARY OF THE INVENTION

It is, therefore, a primary object of the present invention to provide an instant television penalty flag alert system which superimposes a video flag upon the television image that the viewer sees.

Another object is to provide an instant television penalty flag alert system with transmitters that can be held by a number of spotters surrounding a playing field, so that each spotter can activate a hand held transmitter as soon as a predetermined event, such as a penalty is observed.

A yet further object is to provide an instant television penalty flag alert system with a receiver that detects the transmitted signal and superimposes a video flag upon the video images being received from television cameras which are observing the play.

Yet another object is to provide an instant television penalty flag alert system in which different spotters can be identified by differences in their transmitted signals.

A still further purpose is to provide an instant television penalty flag alert system in which the identification of each spotter is made a part of the video flag so that a viewer is able to determine which spotter has signalled an observation.

Yet still further purpose is to provide an instant television penalty flag alert system in which the spotter may signal the location of the predetermined event, such as a penalty, by inputting that information into a transmitter. This information is made an integral part of the video flag so that a viewer may determine, for example, that a penalty has been called at the 50 yard line.

In our efforts to inform the handicapped, a still additional further purpose is to aid deaf viewers as to the penalty situation which are occurring.

A yet additional purpose is where large assemblages of people are gathered watching it may be difficult to sometime hear the comments of the sports announcer, naturally the instant invention also aids over coming this problem.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DESCRIPTION OF THE PREFERRED EMBODIMENTS

Figure 1:
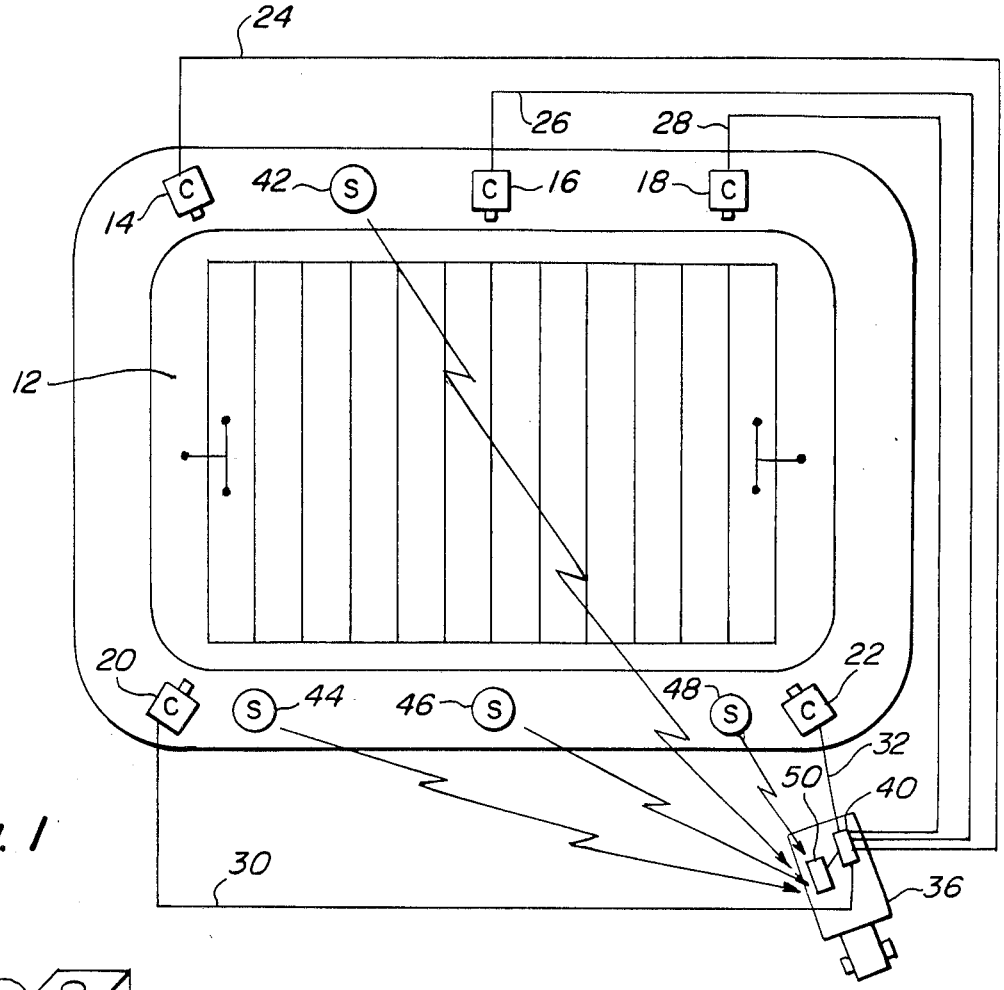
FIG. 1 is a schematic representation of a playing field with television cameras and transmitter equipped spotters in place.
Figure 2:
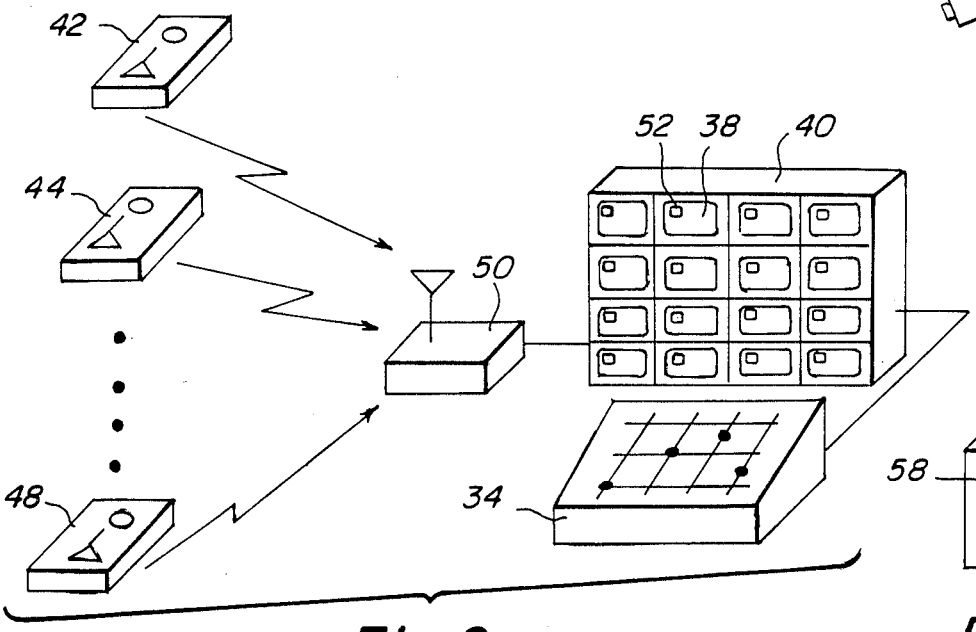
FIG. 2 is a pictorial diagram of the transmitting and receiving equipment depicted in FIG. 1.
Figure 3:
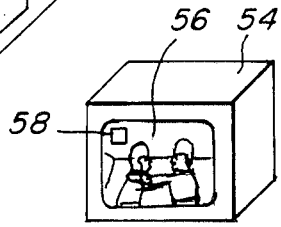
FIG. 3 is a perspective view of a television set illustrating the video image a viewer might see such as two players fighting over the ball together with a superimposed video penalty flag.

In FIG. 1, the playing field 12 (typically a football field) is surrounded by television cameras 14,16,18,20, and 22. Cameramen located at each camera view different parts of the play or view the same play but at different angles. Video images from television cameras 14,16,18,20, and 22 are transmitted along transmission lines 24,26,28,30, and 32 respectively to control panel 34, located inside a mobile control center 36. Each of the video images is viewed on a monitor, such as typical monitor 38 contained in monitor console 40 shown in FIG. 2. An operator, using control panel 34, watches the images from all the monitors and selects the one image to be transmitted to the viewing public. Although five cameras and sixteen monitors are shown, it is understood that any number of cameras and monitors may be used.

A penalty, or any other predetermined event, may occur anywhere on playing field 12. Therefore, spotters observe all areas of play and are equipped with transmitters at 42,44, 46, and 48 respectively. Each transmitter emits electromagnetic radiation which are typically radio waves. A receiver 50 detects the signals from each transmitter and generates a video flag which is superimposed upon all of the images appearing on video monitor console 40. Whenever any of transmitter 42,44,46, or 48 are activated a video flag, such as video flag 52 on monitor 38, appears. This video flag may appear in any desired area of the video display, such as the upper left hand corner as illustrated.

The home viewer sees a video image of the play 56 along with video flag 58 on home television 54. Although four transmitters are shown, it is understood that varying numbers of transmitters will be used according to the game being played.

In some instances it is necessary to ascertain which spotter has reported the event or penalty. In these cases, each transmitter may be coded according to frequency. Each transmitter operates on a different frequency. Alternatively, coding may be accomplished by modulating each transmitted signal differently. Modulation modes include amplitude modulation, frequency modulation, pulse width modulation, and any other modulation mode. This information may be transmitted to the control panel operator, to the announcer, to the audience, or to any combination to the aforesaid.

If the position of the penalty call is desired, each transmitter may be equipped with alpha-numeric inputting so that, for example, a spotter may enter the number 10 if the penalty has occurred on the 10 yard line.

While certain novel features of this invention have been shown and described and are pointed out in the annexed claims, it will be understood that various omissions, substitutions and changes in the forms and the details of the device illustrated and in its operation can be made by those skilled in the art without departing from the spirit of the invention.

What is claimed is:

1. An instant television penalty flag alert system comprising, in combination:

(a) a plurality of portable transmitters, each of which is respectively carried by a spotter for activation upon observing the occurrence of a predetermined event upon a playing field, each of said transmitters comprising means for transmitting a signal on a respective different frequency thereby producing a discernably different signal from each transmitter, said means for transmitting on all of said transmitters including means for transmitting common signals which include coded modulation characteristics to identify position on the playing field and type of penalty;

(b) a video monitor system comprising video camera means for monitoring the palying field, video display means for displaying a video image viewed by the video camera means and transmitting said video image for monitoring on T.V. screens, and (c) a receiver means for receiving the signals transmitted from said plurality of portable transmitters and producing a video flag signal superimposed onto said video image, said flag signal integrally including identification of the particular spotter's position in a stadium, and the type of penalty.

2. An instant television penalty flag alert system, as recited in claim 1, wherein saaid transmitter is a transmitter of electromagnetic radiation.

3. An instant television penalty flat alert system, as recited in claim 1, wherein saaid transmitter transmits radio waves.

4. An instant television penalty flag alert system, as recited in claim 1, wherein said coded modulation characteristics are of an amplitude modulated pulse code.

5. An instant television penalty flag alert system, as recited in claim 1, wherein said coded modulation characteristics are of a frequency modulated pulse code.

6. An instant television penalty flag alert system, as recited in claim 1, wherein said coded modulation characteristics are of a pulse width modulation code.

7. An instant television penalty flag alert system as in claim 1, wherein said coded modulation characteristics are alphanumeric information.

8. A method of transmitting information that a predetermined event has occurred upon a playing field, which comprises the steps of:

(a) positioning a plurality of spotters around the playing field with each of the spotters equipped with a portable transmitter capable of identifying uniquely the spotter and capable of transmitting information relating to the type of event and the location on the playing field of the event;

(b) having the spotters activate their respective transmitter upon their viewing a particular event occurring on the playing field;

(c) receiving the transmitted signals on a common receiver;

(d) superimposing a video flag signal onto video image information being monitored by television camera monitors and being displayed on a common receiver;

(e) including within the flag signal information identifying the particular spotter, the location on the playing field and the type of event occurred;

(f) announcing to a vewing audience that said event has occurred; and (g) transmitting the image signal of the playing field together with the superimposed video flag signal to the viewing audience.

* * * * *